US005131918A

United States Patent [19]

Kelley

[11] Patent Number: 5,131,918

[45] Date of Patent: Jul. 21, 1992

[54] PROCESS FOR DYEING MIXED ANIONIC/CATIONIC POLYAMIDE SUBSTRATES WITH A SPECIFIC TYPE OF VINYL SULFONE DYE

[75] Inventor: Larry C. Kelley, Dalton, Ga.

[73] Assignee: Hoechst Celanese Corporation, Somerville, N.J.

[21] Appl. No.: 626,802

[22] Filed: Dec. 13, 1990

[51] Int. Cl.[5] ..... C09B 62/503

[52] U.S. Cl. ..... 8/549; 8/924; 8/929; 8/DIG. 2

[58] Field of Search ..... 8/549, 924, 929, DIG. 2

[56] References Cited

U.S. PATENT DOCUMENTS

| | | | |
|---|---|---|---|
| 3,118,723 | 1/1964 | Harding | 8/14 |
| 3,663,157 | 5/1972 | Gilgien | 8/65 |
| 3,758,269 | 9/1973 | Bartsch | 8/21 B |
| 3,775,045 | 11/1973 | Buehler et al. | 8/549 |
| 3,790,344 | 2/1974 | Frickenhaus | 8/165 |
| 4,017,255 | 4/1977 | Cobb | 8/531 |
| 4,046,754 | 9/1977 | Meininger et al. | 534/642 |
| 4,218,217 | 8/1980 | Redd, Jr. | 8/531 |
| 4,441,883 | 4/1984 | Vavala | 8/929 |
| 4,492,654 | 1/1985 | Hoyer et al. | 534/827 |
| 4,577,015 | 3/1986 | Jäger et al. | 8/657 |
| 4,693,727 | 9/1987 | Bowles et al. | 8/549 |
| 4,762,524 | 8/1988 | Chambers et al. | 8/549 |
| 4,911,735 | 3/1990 | von der Eltz et al. | 8/549 |
| 4,934,009 | 6/1990 | Yamauchi et al. | 8/549 |

*Primary Examiner*—A. Lionel Clingman
*Assistant Examiner*—Bradley A. Swope

[57] ABSTRACT

The invention is a process for dyeing polyamide substrates comprising anionic and cationic fibers in multicolored patterns. Cross-staining or dyeing of the cationic fibers by the anionic-dyeable nylon colorant is avoided. The anionic dyeable fiber portion is dyed with a fiber-reactive vinyl sulfone dye having one or more sulfonic acid substituents and one or more vinyl sulfone groups with the proviso that the sum of the number of sulfonic acid and vinyl sulfone substituents is at least three. The dyeing process is conducted at a pH of about 2 to about 4. Optionally the cationic portion of the substrate may be dyed with a basic dye in admixture with the vinyl sulfone dye.

20 Claims, No Drawings

PROCESS FOR DYEING MIXED ANIONIC/CATIONIC POLYAMIDE SUBSTRATES WITH A SPECIFIC TYPE OF VINYL SULFONE DYE

BACKGROUND OF THE INVENTION

Polyamide polymers are well known in the art. They are generally prepared by the condensation polymerization of a dicarboxylic acid and a diamine or the condensation of a monoaminomonocarboxylic acid which is normally derived from its internal lactam. Examples of such polyamides are nylon 6,6 or nylon-6 which are respectively prepared from hexamethylene diamine - adipic acid mixtures and epsiloncaprolactam. These polyamides are important fiber forming polymers. Examples of other fiber-forming polyamides are nylon -6/6,6 copolymers, nylon-11, nylon-12 and the nonsynthetic polyamides, wool and silk. Fiber-forming polyamides are well known and are normally dyeable with an acid or direct dye.

It is well known to modify polyamides to make them dyeable with a basic dye. Synthetic polyamides may be modified to render them basic dyeable by replacing a portion of the nylon forming monomer with a corresponding molar amount of sulfonated nylon-forming monomer. U.S. Pat. No. 4,579,762; column 3, lines 24–68 and column 4, lines 1–25 discloses various methods for modifying nylon to render it basic dyeable (i.e. dyeable with a basic dye). U.S. Pat. No. 3,389,172 discloses another such modification procedure; see columns 1 to 3 thereof. The preceding references to U.S. Pat. Nos. 4,579,762 and 3,389,172 are incorporated herein by reference. Natural polyamides can be sulfonated to introduce sulfonic acid groups into the polyamide chains.

For the purpose of this description basic dyeable polyamide is termed cationic polyamide or cationic nylon as the case may be. Acid dyeable polyamides or nylon is termed anionic polyamide or anionic nylon as the case may be.

It is possible to weave or tuft polyamide fibers of the anionic and cationic type into a substrate in a predetermined manner to produce a defined pattern. Theoretically it is then possible to dye the mixed anionic/cationic substrate with an acid dye and obtain a substrate wherein only the anionic portion is dyed. Thus a multicolored pattern is theoretically achieved on the substrate wherein the anionic portion is colored the shade of the acid dye and cationic portion is undyed (white). However, in practice this is not the result. The commonly used monosulfonated acid dyes will severely cross-stain and dye the cationic polyamide portion and when reserving or milling acid dyes are used cross staining and dyeing of the cationic polyamide still occurs.

This invention avoids this cross staining and dyeing of the cationic portion or the substrate. It is now possible with this invention, to obtain maximum multi-color effects. For example, a selected vinyl sulfone dye can be applied in accordance with invention to an anionic/cationic polyamide substrate and the cationic portion will be undyed. Thus, with the invention, it would be possible to obtain a black anionic portion and a white cationic portion with no graying or discoloration of the cationic fibers in the substrate.

SUMMARY OF THE INVENTION

This is a process for producing multi-colored patterns on polyamide substrates and in particular, on polyamide carpeting. A polyamide substrate is prepared by tufting weaving or knitting acid dyeable nylon fibers and basic dyeable nylon fibers together in a predetermined manner to produce a defined pattern. The substrate is then dyed with a fiber-reactive, vinyl sulfone dye having one or more sulfonic acid groups and one or more vinyl sulfone groups with the provision that the sum of the number of the sulfonic acid and vinyl sulfone groups is three or more.

The dyeing process is conducted at a pH of from about 2 to about 4; preferably at a pH of about 2.5 to 3.5. The acid dyeable fibers are dyed the color of the vinyl sulfone dye with no cross staining of the basic dyeable fiber. Optionally, the substrate may be dyed with a basic dye in admixture with the fiber reactive vinyl sulfone dye. The process produces a multi-colored pattern on the substrate with essentially no cross-staining of the fibers by the dyes wherein the vinyl sulfone dye dyes only the acid dyeable fiber and the basic dye dyes the basic dyeable fiber.

DESCRIPTION OF THE PREFERRED EMBODIMENTS

Acid dyeable polyamide fibers (anionic polyamide) and basic dyeable polyamide fibers (cationic polyamide) are well known in the textile and carpet art. These fibers can be knitted, woven or tufted into a substrate in a manner such that a defined pattern is achieved. It is the object of this invention to achieve multi-colored dyeings of such mixed anionic/cationic polyamide substrates without cross-staining or dyeing the cationic fibers with the acid dye colorant. The process of the invention can be used to dye the anionic fibers of such substrates a desired color while leaving the cationic portion undyed.

Acid dyeable polyamides are unmodified polyamides in which the functional groups in the polymer chain are cationic ($—NH_2$) and capable of forming an ionic bound with a dye containing anionic functional groups ($—SO_3X$, where X is hydrogen or a cation). In basic dyeable polyamides the functional groups in the polymer chain are anionic ($—SO_3X$ or —COOX) and dyeable with a dye containing cationic groups.

Theoretically, it should be possible to dye the anionic fibers of a mixed anionic/cationic fiber substrate with an acid or anionic dye without staining or dyeing the cationic fibers of the substrate. Likewise, it should be theoretically possible to dye the cationic fibers with a basic dye without staining or dyeing the anionic fibers of the mixed fiber substrate. However, in practice, the commonly used acid dyes will stain and dye cationic polyamide fibers. Although, the acid dye does not build as strong a shade on the cationic fiber as it does on the anionic fiber, the amount of color build up is significant.

This invention avoids the problem of undefined secondary staining or dyeing of a fiber in a mixed anionic/-cationic polyamide substrate. I have found that certain fiber-reactive vinyl sulfone dyes when applied at moderately low to low pH will not dye or stain cationic polyamide fibers.

The fiber-reactive, vinyl sulfone type dyes useful in the practice of the invention are well known. The main use of such fiber-reactive, vinyl sulfone type dyes has been in the dyeing of cotton. However, U.S. Pat. Nos.

3,802,837 and 4,762,524 teach their use in the dyeing of polyamides. These prior art references teach to use the vinyl sulfone dye as a reaction product with a substituted, secondary, aliphatic amine such as n-methyltaurine.

The following patents illustrate that the vinyl sulfone type dyes are well known:

U.S. Pat. No. 4,336,190 (formazon)
U.S. Pat. No. 4,492,654 (disazo);
U.S. Pat. No. 4,046,754 (monoazo);
U.S. Pat. No. 4,577,015 (dioxazine);
U.S. Pat. No. 3,359,286; 4,049,656 (anthraquinone);
U.S. Pat. No. 3,268,548 (phthalocynine) and;
U.S. Pat. No. 3,385,843 (pyrazolone).

The teachings of the above cited patents are hereby incorporated by reference.

Suitable dyes of the vinyl sulfone type ma be represented by the following general formula:

$$(SO_3M)_m—D—(SO_2—Z)_n$$

In the above formula, "D" represents a dye chromophore selected from the anthraquinone, dioxazine, formazon, phthalocyanine, mono- and disazo series and their metal complexes wherein the metal is selected from copper, chromium, iron, cobalt and nickel; preferably copper or nickel. Particularly preferred are those chromophores of the mono- and disazo series and their metal complexes. "Z" represents the fiber reactive groups: $—CH=CH_2$ and $—CH_2—H_2—Y$ wherein "Y" is a substituent capable of being split off by an alkaline reagent: e.g., chlorine, bromine, thiosultate, sulfato, phosphato, a carboxylic acyloxy of one to four carbon; or by an acidic reagent: e.g., dimethylamino, diethylamino, N-alkyl ($C_1$ to $C_4$)-amino-alkyl ($C_1$ to $C_4$) sulfonic or carboxylic acids ($C_1$ to $C_4$) The sulfato group is preferred. The term "n" represents an integer from 1 to 3; preferably 1 to 2. The term "m" represents an inreger from 1 to 4, preferably 1 to 3 and most preferably 1 to 2. The term "M" represents hydrogen and the metals sodium, potassium, lithium or calcium; preferably sodium. The dye chromophore may contain additional fiber reactive groups: e.g. a mono- or di-halogen-s-triazine, a mono cyanamido-s-triazine, a mono-, di- or trihalogen pyrimidine, a mono or dichloroquinoxaline, a dichlorophthalazine, a dichloropyridazone or the bromine or fluorine derivatives thereof. As used in this description and the claims hereto, the term "vinyl sulfone group" or "vinyl sulfone substituent" means the group $—(SO_2—Z)$. The vinyl sulfone dyes useful in the invention may be employed in their water-soluble metal salt form, particularly useful are the metals sodium, potassium and lithium; most preferred sodium.

Vinyl sulfone dyes with a single vinyl sulfone group and a single sulfonic acid group will stain and dye cationic polyamides to a moderate degree. Vinyl sulfone dyes with two or more sulfonic acid group and one vinyl sulfone do not dye cationic polyamide. Vinyl sulfone dyes with one sulfonic acid group and two vinyl sulfone groups will not dye cationic polyamides. Similarly, vinyl sulfone dyes with two or more sulfonic acid groups and two or more vinyl sulfone groups or monochlorotriazine groups also perform well. In summary the vinyl sulfone dyes useful in this invention preferably have one or more sulfonic acid substituents and one or more vinyl sulfone substituents and optionally a monochlorotriazine substituent with the proviso that the sum of the number of sulfonic acid, vinyl sulfone and monochlorotriazine substituents is three or more. The monochlorotriazine fiber reactive group may be substituted by a mono or di-fluorine or bromine-s-triazine, a mono or dichloroquinoxaline, a dichlorophthalazine, a dichloropyridazone or the bromine or fluorine derivatives thereof.

Control of the pH is important to the process and must be controlled carefully throughout the dyeing cycle. At pH valued above 4.0 the yield of the vinyl sulfone dyes decreases rapidly as the pH increases. If the pH range is between 3.0–4.0, the yield is good and the reserve (no staining) of the cationic dyeable nylon fiber is excellent, although there is some color loss at the 4.0 pH on the anionic fibers. At pH values between 2.0–3.0, the yield reaches a maximum, but some cross staining of the cationic fiber occurs. Also certain metallized vinyl sulfone dyes begin to de-metallize at very low pH's and experience shade changes and loss of light fastness. The optimum pH range is between about 2.5–3.5, with about 3.0 being the preferred value for the process.

If vinyl sulfone and cationic dyes are used in admixture, an anti-precipitant chemical must be employed and in practice 2.0 g/l of 30% active oleyl amine wirh 30 moles of ethylene oxide has proved to be effective. To compatiblize the vinyl sulfone dyes' strike rates, 2.0 g/l of a 30% active tallow amine with 15 moles of ethylene oxide has been found to be effective. Anionic chemicals such as dioctyl sulfosuccinate wetting agents and sodium dodecyl diphenyloxide disulfonate levelling agents can retard the fixation of vinyl sulfone dyes and; therefore, should not be used. Sequesterants such as ethylenediamine tetra-acetic acid and nitrilotriacetic acid can complex and retard metallized vinyl sulfone dyes, so water softeners such as hexametaphosphates should be substituted.

Because of their slow fixation rates, vinyl sulfone dyes should be steamed a minimum of 6 minutes in a saturated steam atmosphere and 8 minutes would be the optimum. After steaming the washing cycle is also important since some of the vinyl sulfone dyes and cationic dyes are physically located in areas on the carpet where no bonding was possible, i.e.—vinyl sulfone dyes on the cationic dyeable nylon fiber. It has been found that washing temperatures of 110°–120° F. give the best results and an anionic and/or cationic soaping or scavenging agent may also provide additional excess dye removal. The fixing and washing steps in a dyeing process are well known in the art and variations in the above parameters may be made to suit the specific requirements of the pertinent dyeing operation.

Optionally acid, direct and disperse dyes may be used in the dye formulation to achieve desired styling and/or color effects.

Conventional methods of applying dyes to a substrate can be used in producing multi-colored dyeing according to the invention. The method of the invention may be practiced by batchwise exhaust dyeing methods or continuous dyeing methods. The exhaust dyeing method is well known as are the continuous dyeing methods. These methods of application include padding, printing, spraying, dropping etc. Illustrative machines or apparatus known in the art for continous application of dyes and useful in the practice of the invention are rotary screen printers, TAK® machines, jet printers, pad rolls, spray nozzles etc. The application methods vary widely in continuous dyeing depending upon the type and placement of application equipment on the line and are obvious to the skilled artisan.
TABLE I
VINYL SULFONE DYES
YELLOW 1
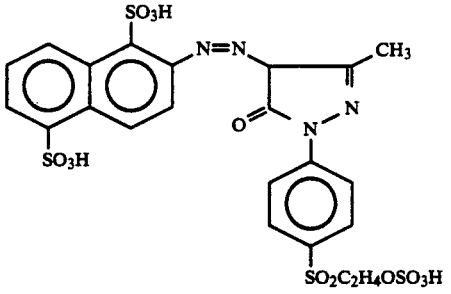
YELLOW 2
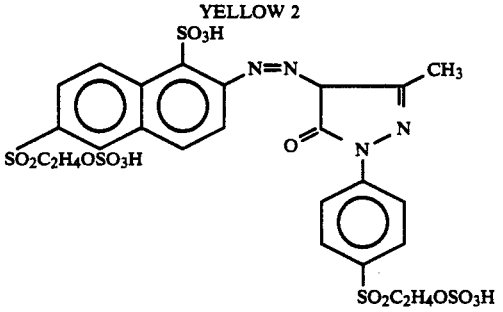
RED 1
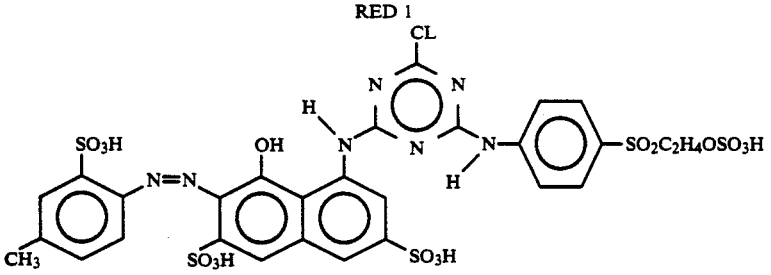
BLUE 1
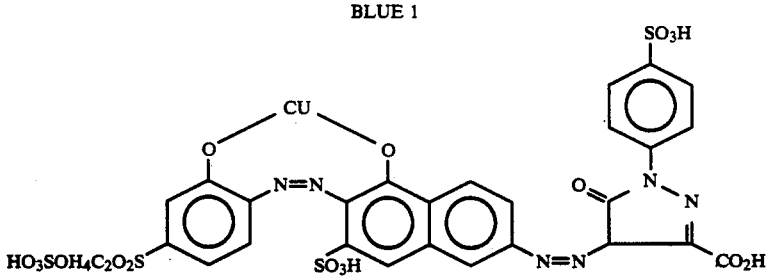
BLACK 1
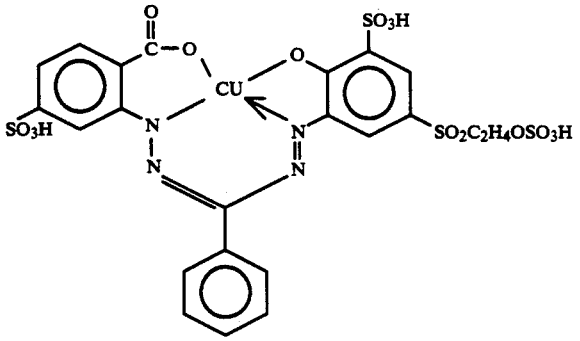
RED 2

TABLE I-continued

VINYL SULFONE DYES

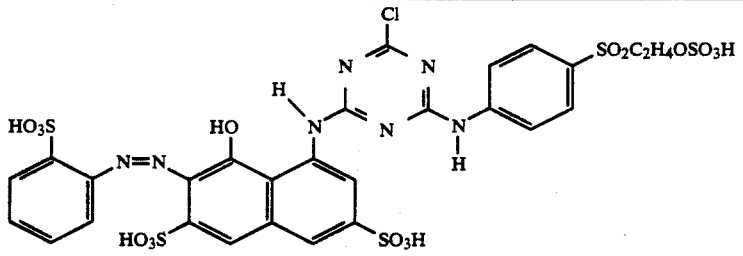

YELLOW 3

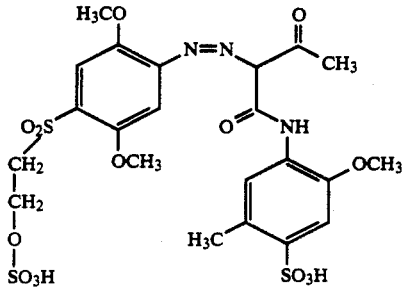

BORDEAUX 1

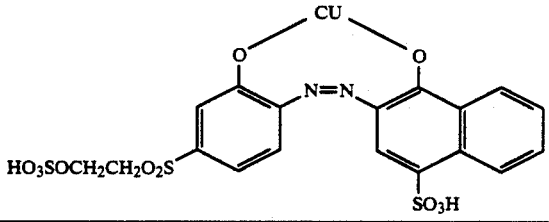

For reference purposes the structure of the vinyl sulfone dyes used in the following examples are set forth in the previous Table 1. Basic, acid and disperse dyes used in the following examples are identified by their Color Index Number and Classification. The following examples illustrate the invention.

EXAMPLE 1

A pale rose shade was made using:

0.05 g/l Yellow 1 Dye
0.04 g/l Red 2 Dye
0.02 g/l Blue 1 Dye

These dyes were incorporated into a printing paste. The general formula for printing the paste was:

XX.X g/l Dye
13.8 g/l CP7 Guar Thickener
4.7 g/l Progawet VF (nonionic wetter)
2.7 g/l Antifoam 73 (defoamer)
1.3 g/l Sulfamic acid
pH—3.0 viscosity—2200 cps The dye paste was printed using 4 strokes on a flat bed screen printer on backed nylon carpet 66 which had been tufted in such a manner such that ⅓ of the face fiber was cationic dyeable nylon and the other ⅔ was acid dyeable nylon. The printed carpet was steamed for 8 minutes, then washed and dried. The acid dyeable end was a pale rose shade while the cationic end was left completely white.

EXAMPLE 2

A maroon shade was made with the formula:

1.5 g/l Yellow 3 Dye
1.5 g/l Red 2 Dye
1.5 g/l Blue 1 Dye

The remainder of the print formula and dyeing procedure was the same as in Example 1. After steaming for 8 minutes, washing and drying, the acid end was a dark maroon and cationic end was white.

EXAMPLE 3

A brown shade was made with the formula:

4.0 g/l Yellow 1 Dye
1.5 g/l Red 1 Dye
2.1 g/l Blue 1 Dye

The remainder of the print formula and dyeing procedure was the same as in Example 1. After steaming for 8 minutes, washing and drying, the acid end was a dark brown and the cationic end was white.

EXAMPLE 4

A black shade was made with the formula:

5.0 g/l Black 1 Dye

Following the same procedures as in the previous examples, the resultant shade was a full, dark black with a white cationic end.

EXAMPLE 5

A teal and a rose shade was made with the formula:

0.50 g/l Yellow 1 Dye
2.50 g/l Blue 1 Dye
2.00 g/l oleyl amine—30 mole ethylene oxide adduct, antiprecipitant
0.20 g/l CI Basic Yellow 15 Dye
0.14 g/l CI Basic Red 46 Dye 0.08 g/l CI Basic Blue 94:1 Dye Following the same procedures as in the previous examples, the resultant shade was a deep teal on the acid dyeable end and a pale rose on the cationic end.

EXAMPLE 6

A wine and grey shade were made with the formula:

0.50 g/l Yellow 1 Dye
2.00 g/l Red 1 Dye
0.20 g/l Blue 1 Dye
2.00 g/l oleyl amine—30 mole ethylene oxide adduct, antiprecipitant
0.10 g/l CI Basic Yellow 15 Dye
0.10 g/l CI Basic Red 46 Dye
0.50 g/l Basic Blue 94:1

Following the same procedures as in the previous examples, the resultant shade was a deep wine color on the acid dyeable end and a pale grey on the cationic end.

EXAMPLE 7

A brown shade was made with the formula:

3.0 g/l Yellow 1 Dye
1.0 g/l Bordeaux 1 Dye
1.0 g/l Blue 1 Dye

Following the same procedures as in the previous examples, the resultant shade was a brown on the acid dyeable end and a pale bluish pink on the cationic end. In this case the mono-sulfonated, single vinyl sufone Bordeaux 1 proved to be an unsuitable dye for this process due to its dyeing of the cationic dyeable end.

EXAMPLE 8

A black and pink shade was made with the formula:

0.05 g/l CI Acid Red 337, 200%
4.00 g/l Black 1 Dye

Following the same procedure as in the previous examples, the resultant shade was a reddish black acid end and a pink cationic end. The mono-sulfonated acid dye (AR 337) will dye the cationic end to nearly the same depth as the acid end; therefore, the use of regular acid dyes in this application limits the range of styling effects. In this case the CI Acid Red 337 shifted the normally true shade of Black 1 to the red side.

EXAMPLE 9

A printing paste was made using the following colorants:

0.10 g/l CI Disperse Yellow 3
4.00 g/l Blue 1 Dye

Following the same procedures as in previous examples, the resultant shade was a slightly greenish blue acid end and a yellow cationic end. The disperse dye (DY 3) will dye both the acid and cationic end to nearly the same shade, so whatever color is on the cationic end, yellow in this case, will also be on the acid end and cause a color shift in the final vinyl sulfone dyes shade, greenish in this case. Again, the styling effects are limited somewhat when disperse dyes are employed.

I claim:

1. A process for dyeing a polyamide substrate having contained therein anionic polyamide fibers and cationic polyamide fibers wherein said process comprises:

(a) applying at least one vinyl sulfone dyes to said substrate in an amount effective to obtain the desired color; wherein said vinyl sulfone dye is applied to said substrate in an aqueous medium at a pH of about 2 to about 4; wherein said vinyl sulfone dye contains at least one sulfonic acid substituent or salt thereof and at least one fiber reactive vinyl sulfone substituent with the proviso that the sum of the number of fiber-reactive vinyl sulfone substituents and sulfonic acid substituents or salts thereof is at least three and (b) fixing said dye to the fibers of said substrate.

2. A process for dyeing a polyamide substrate having contained therein anionic polyamide fibers and cationic polyamide fibers wherein said process comprises:

(a) applying at least one vinyl sulfone dye to said substrate in an amount effective to obtain the desired color effect; wherein said vinyl sulfone dye is applied to said substrate in an aqueous medium at a pH of about 2 to about 4; wherein said vinyl sulfone dye contains at least one sulfonic acid substituent and at least one fiber reactive vinyl sulfone substituent and at least one fiber reactive substituent selected from mono-or-di-halo-s-triazine, mono-, di or tri-halopyrimidine, mono-cyanamido-s-triazine, mono and dichloroquinoxaline, a dichlorophthalazine, dichloropyridazone and the bromo or fluoro analogs thereof with the proviso that the sum of the number of fiber-reactive substituents and sulfonic acid substituents or salts thereof is at least three and (b) fixing said dye to the fibers of said substrate.

3. A process according to claim 1 wherein one or more basic dyes are applied to said substrate.

4. A process according to claim 1 wherein said dyeing is conducted at pH of about 2.5 to about 3.5.

5. A process according to claim 1 wherein said anionic polyamide is selected from nylon, nylon 6-6 and mixtures thereof.

6. A process according to claim 5 wherein said polyamide substrate is in the form of a tufted nylon carper.

7. A process according to claim 2 wherein one or more basic dyes are applied to said substrate.

8. A process according to claim 2 wherein said dyeing is conducted at a pH of about 2.5 to about 3.5.

9. A process according to claim 2 wherein said anionic polyamide is selected from nylon 6, nylon 6-6 and mixtures thereof.

10. A process according to claim 9 wherein said anionic polyamide substrate is in the form of a tufted nylon carpet.

11. A polyamide substrate dyed in accordance with the process of claim 1.

12. A polyamide substrate dyed in accordance with claim 2.

13. A polyamide substrate dyed in accordance with claim 3.

14. A polyamide substrate dyed in accordance with claim 4.

15. A polyamide substrate dyed in accordance with claim 5.

16. A polyamide substrate dyed in accordance with claim 6.

17. A polyamide substrate dyed in accordance with claim 7.

18. A polyamide substrate dyed in accordance with claim 8.

19. A polyamide substrate dyed in accordance with claim 9.

20. A polyamide substrate dyed in accordance with claim 10.

* * * * *